US009347752B2

(12) United States Patent
Blin et al.

(10) Patent No.: US 9,347,752 B2
(45) Date of Patent: May 24, 2016

(54) CONNECTING ELEMENT FOR A BODY MADE OF COMPOSITE MATERIAL OF A PIERCING PROJECTILE

(75) Inventors: Michel Blin, Bourges (FR); Germain Chevalier, Paris (FR)

(73) Assignee: MBDA France, Paris (FR)

( * ) Notice: Subject to any disclaimer, the term of this patent is extended or adjusted under 35 U.S.C. 154(b) by 0 days.

(21) Appl. No.: 14/119,012

(22) PCT Filed: May 15, 2012

(86) PCT No.: PCT/FR2012/000196

§ 371 (c)(1), (2), (4) Date: Jan. 29, 2014

(87) PCT Pub. No.: WO2012/160271

PCT Pub. Date: Nov. 29, 2012

(65) Prior Publication Data

US 2014/0150682 A1 Jun. 5, 2014

(30) Foreign Application Priority Data

May 24, 2011 (FR) ..... 11 01605

(51) Int. Cl.

| | |
|---|---|
| ***F42B 12/74*** | (2006.01) |
| ***F42B 10/46*** | (2006.01) |
| ***F42B 10/52*** | (2006.01) |
| ***F42B 12/08*** | (2006.01) |
| ***F42B 12/76*** | (2006.01) |

(52) U.S. Cl.

CPC ..... *F42B 12/745* (2013.01); *F42B 10/46* (2013.01); *F42B 10/52* (2013.01); *F42B 12/08* (2013.01); *F42B 12/76* (2013.01)

(58) Field of Classification Search

CPC ..... F42B 5/28; F42B 12/02; F42B 12/08; F42B 12/44

USPC ..... 102/519, 517; 428/34.1

See application file for complete search history.

(56) References Cited

U.S. PATENT DOCUMENTS

| | | | | |
|---|---|---|---|---|
| 3,641,936 | A * | 2/1972 | Barnett | 102/214 |
| 4,147,107 | A * | 4/1979 | Ringdal | 102/467 |
| 5,311,820 | A * | 5/1994 | Ellingsen | 102/481 |
| 5,567,908 | A | 10/1996 | McCubbin et al. | |
| 6,845,716 | B2 * | 1/2005 | Husseini et al. | 102/466 |
| 7,441,504 | B2 * | 10/2008 | Husseini et al. | 102/466 |
| 8,443,730 | B2 * | 5/2013 | Padgett | 102/466 |

(Continued)

FOREIGN PATENT DOCUMENTS

| | | |
|---|---|---|
| FR | 1292383 | 5/1962 |
| GB | 2267858 | 12/1993 |
| JP | 59159414 | 9/1984 |

*Primary Examiner* — Benjamin P Lee

(74) *Attorney, Agent, or Firm* — Duane Morris LLP; J. Rodman Steele, Jr.; Gregory M. Lefkowitz

(57) ABSTRACT

According to the invention, the rear part of the connecting element (1), which part is intended to be connected to a body (4) made of composite material, comprises at least one abutment (13) of annular shape, centered with respect to a longitudinal axis (10) and intended to come into contact with the front edge (14) of said body (4), and a longitudinal rearward extension (15) which is defined from said abutment (13) onward and which comprises a contact face (16) and has a shape and diameter suited to said body (4) so that its contact face (16) can come laterally into contact with a peripheral surface (17) thereof.

12 Claims, 3 Drawing Sheets

(56) References Cited

U.S. PATENT DOCUMENTS

| | | | | |
|---|---|---|---|---|
| 8,813,650 | B2 * | 8/2014 | Maljkovic et al. | 102/466 |
| 2001/0013299 | A1 * | 8/2001 | Husseini et al. | 102/466 |
| 2003/0167952 | A1 * | 9/2003 | Heidenreich et al. | 102/431 |
| 2004/0082394 | A1 | 4/2004 | Lee et al. | |
| 2005/0115446 | A1 * | 6/2005 | Heitmann et al. | 102/469 |
| 2005/0188883 | A1 * | 9/2005 | Husseini et al. | 102/466 |
| 2005/0257711 | A1 * | 11/2005 | Husseini et al. | 102/466 |
| 2005/0257712 | A1 * | 11/2005 | Husseini et al. | 102/466 |
| 2006/0011087 | A1 * | 1/2006 | Husseini et al. | 102/466 |
| 2008/0028971 | A1 * | 2/2008 | Scott | 102/306 |
| 2009/0044717 | A1 * | 2/2009 | Husseini et al. | 102/466 |
| 2012/0111219 | A1 * | 5/2012 | Burrow | 102/467 |
| 2013/0014665 | A1 * | 1/2013 | Maljkovic et al. | 102/467 |
| 2014/0060373 | A1 * | 3/2014 | Maljkovic et al. | 102/467 |
| 2014/0076188 | A1 * | 3/2014 | Maljkovic et al. | 102/467 |

* cited by examiner

CONNECTING ELEMENT FOR A BODY MADE OF COMPOSITE MATERIAL OF A PIERCING PROJECTILE

CROSS-REFERENCE TO RELATED APPLICATIONS

This application is a §371 national stage entry of International Application No. PCT/FR2012/000196, filed on May 15, 2012, which claims priority to French Patent Application No. 1101605, filed May 24, 2011, the entire contents of which are incorporated herein by reference.

The present invention relates to a connecting element for connecting an element (preferably a metal nose) of a piercing military projectile to a cylindrical body made of composite material of said projectile, and a metal nose and a projectile equipped with this type of connecting element.

The present invention relates to a piercing military projectile, which may in particular equip a missile, which is provided with a cylindrical body made of composite material, filled with an explosive, and a nose which is arranged at the front of said body.

It is known that to improve the ratio between the mass of explosive and the total mass of this type of piercing military projectile, increasingly efforts are being made to replace the conventional steel of the structure of the projectile with much lighter composite materials, in particular at the cylindrical body. However, the use of steel is still necessary, in particular at the front of the projectile, to provide scratch resistance upon impact with a target, in particular a target made of concrete. In addition, the use of steel allows easy machining of the nose of the projectile.

However, this type of mixed production (steel/composite material), which appears very advantageous, requires particular features to be present at the connection between the composite material of the projectile body and the steel of the nose of said projectile, in order to be completely effective. This connection must first be strong enough to avoid separation of the portion made of steel and the portion made of composite material on impact. Moreover, this connection must also help the composite material to withstand the piercing stresses likely to be encountered. When piercing very thick concrete targets in particular, the piercing military projectile undergoes very significant stresses. It may in particular be subjected to deceleration of approximately 10,000 g upon impact.

More specifically, when a piercing military projectile arrives at a target with a non-zero angle of impact, three main phenomena contribute to the appearance of stresses in the body of the projectile:

- axial compression due to the impact with the target;
- bending of the body, in the presence of an angle of impact; and
- movement of the explosive inside the body, which applies a radial force to the body of the projectile.

The present invention relates to a connecting element for connecting an element (preferably a metal nose) of a piercing military projectile to a composite-material body (preferably a cylindrical body) of said projectile, the design of which allows the above-mentioned drawbacks to be overcome and, in particular, the stresses indicated above to be withstood.

Said connecting element is therefore remarkable, according to the invention, in that the rear portion thereof, intended to be connected to said body made of composite material, comprises at least:

- one abutment of annular shape, centred with respect to its longitudinal axis, which is intended to come into contact with the front edge of said (preferably cylindrical) body; and
- one longitudinal rearward extension, which is defined from said abutment onwards, comprises a contact face, and has a shape and diameter suited to said body so that its contact face can come laterally into contact with a peripheral surface thereof.

In the context of the present invention, the body made of composite material is preferably, but not exclusively, cylindrical in shape. In the description below, reference is generally made (but not in a limiting way) to said preferred cylinder-shaped embodiment.

Thus, because of the above-mentioned features of said connecting element which is made of metal, preferably of steel or any other dense and resilient material (that has good resistance to impact), the mechanical strength of the projectile is improved. In fact:

- the significant lateral contact or support obtained by the longitudinal extension on a peripheral surface (internal or external) of the body allows the hydrodynamic effects of the explosive, as well as the bending stresses during piercing, to be withstood; and
- the abutment (in combination with the longitudinal extension) allows the axial compression (due to the impact with the target) to be transmitted to said body, which is able to withstand this compression.

Therefore, because of the invention, the composite material works almost exclusively in axial compression (in other words in the range where it is most effective), while the connecting element compensates for the radial stresses (due to the movement of the explosive inside the projectile), as well as for a large portion of the bending stresses of the entire projectile upon impact with a target at an angle of incidence.

As, the composite material therefore works under stress practically only where it is strongest, the features thereof (thickness, space requirement, mass, etc.) can be optimised in particular to seek a weight-saving. This type of weight-saving achieved due to the invention can be used for additional or denser explosive. The performance of the entire piercing military projectile can therefore be improved using the connecting element according to the invention.

As well as contributing to the mechanical strength of the body of the projectile, the longitudinal extension of the connecting element provides a large contact surface, which is sufficient to allow bonding between the body made of composite material and the connecting element (made of metal, preferably steel). By using bonding to connect these parts rigidly, there is no need to machine or drill the composite material such as, for example, when fastening with screws. The fibres making up the composite material (and providing the basic mechanical strength of the composite material) are therefore not damaged or cut. The mechanical properties of the composite material are therefore not damaged by the fastening. Moreover, the adhesive used can be selected according to the environmental conditions in which the projectile is used, which allows fastening to be improved.

In a first embodiment, said longitudinal rearward extension has a diameter suited to said cylindrical body so that it can come into contact laterally with a radially external face thereof. In this embodiment, the longitudinal extension of the connecting element therefore surrounds the front portion of the cylindrical body and is bonded by its radially internal face to the radially external face thereof.

In a particular variant, the contact face of said longitudinal extension, intended to come into contact with the cylindrical body, is provided with at least one channel forming a recess, preferably annular-shaped, which is able to receive the adhesive. The dimensions of this channel are such that it can receive enough adhesive to produce suitable fastening.

In this first embodiment, said abutment has at least one contact surface, and preferably a plurality of contact surfaces which succeed each other in the radial direction (directly or via a lateral contact face). In the context of the invention, such a contact surface can:

- either be situated in a plane which is radial relative to said longitudinal axis;
- or have a conical shape which, towards the rear, extends outwards.

In the context of the present invention, any possible combination of these different contact surfaces can be envisaged. This allows advantageous contact to be produced between the abutment and the front face of the cylindrical body, in particular to transmit the forces generating the axial compression effectively to said cylindrical body.

Moreover, in a second embodiment, said longitudinal rearward extension has a diameter suited to said cylindrical body so that it can come into contact laterally with a radially internal face thereof. In this embodiment, the longitudinal extension of the connecting element therefore penetrates into the front portion of the cylindrical body and is bonded by its radially external face to the radially internal face thereof.

Preferably, in this second embodiment, the connecting element also comprises an annular lip connected to the outer edge of the abutment and arranged so that it can come into contact laterally with a radially external face of the front edge of said cylindrical body. This annular lip therefore allows the composite material to be retained upon impact and prevents delamination at the end thereof when crushed against a more rigid structure (the steel of the nose). Advantageously, this lip is arranged longitudinally opposite said longitudinal extension in order to form, with said abutment and said extension, a housing for the front portion of the body made of cylindrical material, allowing three-way contact between the connecting element and said front portion.

Furthermore, in a first variant, said connecting element is an independent element which is used as an intermediate connecting element between the metal nose and the cylindrical body of a projectile. To do this, said connecting element advantageously comprises at the front portion thereof, connection means allowing it to be connected, for example by screwing, to a metal nose of a piercing military projectile.

Moreover, in a second variant, said connecting element corresponds to the rear portion of a metal nose of a piercing military projectile. In this variant, the connecting element is therefore an integral part of the metal nose which is designed to be mounted on the cylindrical body of the projectile.

The connecting element according to the invention, which therefore contributes to the retention of the composite material and which plays a dominant role in the mechanical impact resistance of the entire projectile, also has the following advantages;

- it is suitable for any type of composite material; and
- it allows optimised use of the composite material (by working principally in axial resistance) and it simplifies the production of the body made of composite material. In fact, the portion made of composite material can be produced from a simplified geometry, for example in the form of a tube (cylinder).

The present invention also relates to a piercing military projectile that can in particular equip a missile, provided in particular with a (cylindrical) body made of composite material, which is filled with explosive or other material, and with a nose which is arranged at the front of said cylindrical body.

According to the invention, said projectile is remarkable in that it comprises a connecting element such as that mentioned above, which is arranged so as to connect said nose to said cylindrical body made of composite material.

In a particular embodiment, the radially successive walls, made of metal and composite material, of said projectile at the connection are such that the rigidity thereof under pressure increases radially outwards from the axis, so that each of them is pressed firmly and laterally against the one outside it.

In the preceding description, which relates to the preferred embodiment of the invention, the connecting element is intended to connect a metal nose to a composite-material body on a projectile. However, in the context of the present invention, the connecting element can also be used to connect another element, for example rear closing means, to the body made of composite material.

The figures of the accompanying drawings will explain how the invention can be produced. In these figures, identical references designate similar elements.

Figure 4:
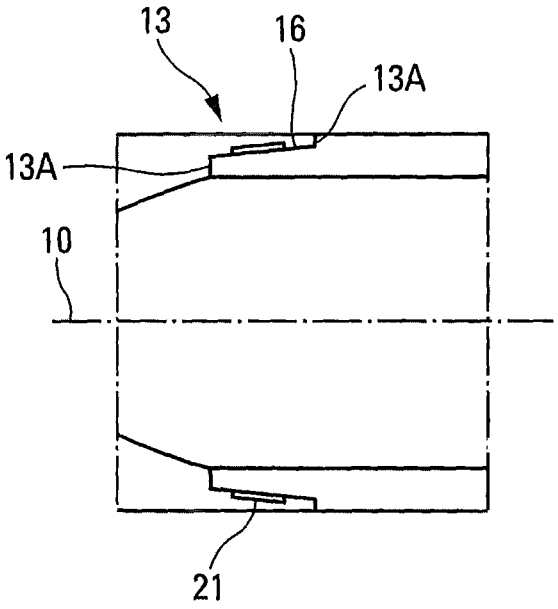
FIGS. 4 and 5 are views similar to that of FIG. 2, which show different embodiments of the contact surfaces respectively.
Figure 5:
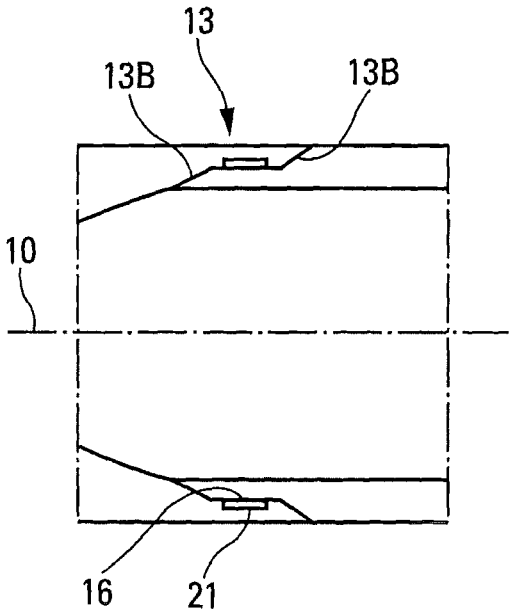
Figure 6:
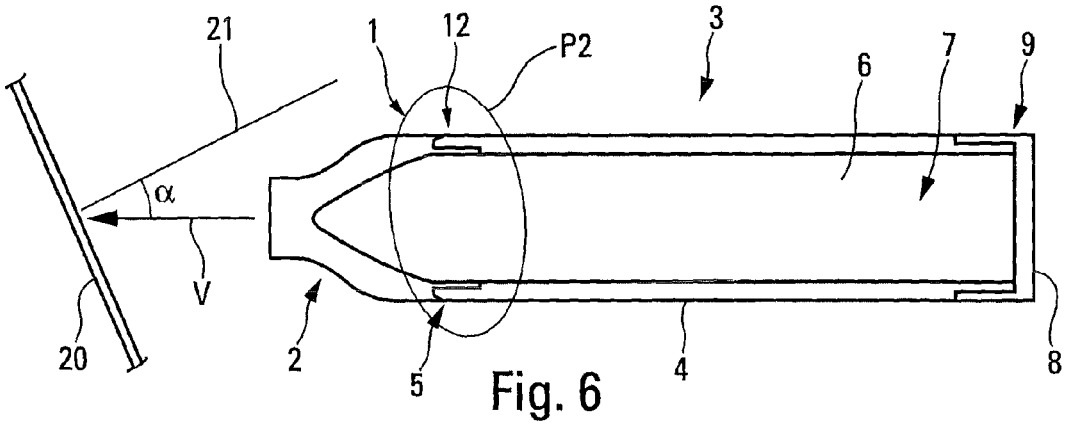
FIGS. 6 to 8 are similar views to those of FIGS. 1 to 3 respectively of a piercing military projectile provided with a connecting element, according to a second embodiment of the invention.
Figure 7:
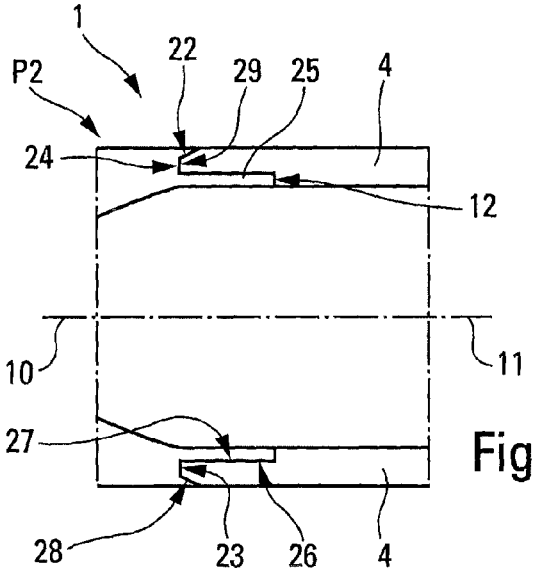
Figure 8:
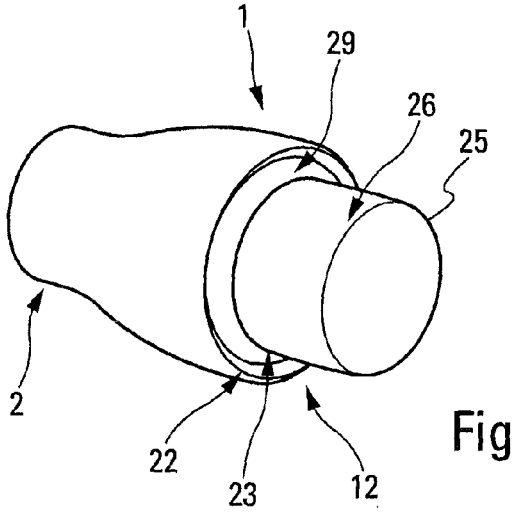

The object of the connecting element 1 according to the invention and shown diagrammatically, in a first embodiment in FIGS. 1 to 5 and in a second embodiment in FIGS. 6 to 8, is to connect a metal nose 2 of a piercing military projectile 3 to a composite-material body 4 of said projectile 3. In the description below, the body 4 is preferably (but not exclusively) cylindrical in shape. As shown diagrammatically in FIGS. 1 and 6, this piercing military projectile 3, which can in particular equip a missile, is provided conventionally, in addition in particular to said cylindrical body 4 and said nose 2 which is arranged at the front 5 of said cylindrical body 4, with a conventional explosive 6 (or another material) which fills the space 7 provided inside said cylindrical body 4 and conventional closing means 8 of said internal space 7, provided at the rear 9 of said cylindrical body 4. Said connecting element 1 has a longitudinal axis 10 which, in the assembled position (shown for example in FIGS. 2 and 7), merges with the longitudinal axis 11 of the cylindrical body 4 (and therefore of the projectile 3).

According to the invention, the rear portion 12 of said connecting element 1, intended to be connected to the front 5 of said cylindrical body 4 made of composite material, comprises at least:

- one annular abutment 13, 23, which is centred with respect to the longitudinal axis 10, and which is intended to come into contact with the front edge 14, 24 of said cylindrical body 4. Annular is intended to refer to a closed curve, which is preferably but not exclusively circular; and
- one longitudinal extension 15, 25, which extends rearwards, of the connecting element 1, is defined from said abutment 13, 23 onwards, comprises a contact face 16, 26 and has a cylindrical shape, as well as a diameter suited to the diameter of said cylindrical body 4 so that, with its contact face 16, 26, it can come into contact laterally with a peripheral surface 17, 27 thereof. Preferably, this longitudinal extension 15, 25 has a length that depends on the level of pressure applied by the explosive and by the amount of bending expected on impact.

In the following description, the notions "front" and "rear" of a part are defined relative to the front and rear position on the projectile 3 during a forward movement thereof (as shown by an arrow V in FIGS. 1 and 6).

Thus:

- the significant lateral contact or support obtained by the longitudinal extension 15, 25 (via its contact face 16, 26) on a peripheral surface 17, 27 of said cylindrical body 4 allows in particular the hydrodynamic effects of the explosive 6 to be withstood, as well as the bending forces during piercing. The radial stresses (due to the movement of the explosive 6 inside the projectile 3), as well as a large portion of the bending forces of the entire projectile 3 upon impact (FIG. 1) with a target 20 at an angle of incidence $\alpha$ (relative to a line 21 perpendicular to the plane of the target 20) are borne by the connecting element 1 and the nose 2; and
- the abutment 13, 23 (in combination with the retention produced by the longitudinal extension 15, 25) allows the axial compression due to the impact with the target 20 to be transmitted to said cylindrical body 4 which, because of its particular features, is able to withstand this compression.

The above features of said connecting element 1 which is made of metal, preferably of steel or any other dense and resilient material (that has good impact resistance), allow the mechanical strength of the projectile 3 to be improved.

Because of these features of said connecting element 1, the composite material of the body 4 works almost exclusively in axial compression (in other words in the range where it is most effective), whereas the connecting element 1 and the nose 2 compensate for the radial stresses (due to the movement of the explosive 6 inside the projectile 3), and also for a large portion of the bending forces of the entire projectile 3 upon impact with a target 20 at an angle of incidence $\alpha$.

As, the composite material is therefore working under stress practically only where it is strongest, the features thereof (thickness, space requirement, mass, etc.) can be optimised, in particular to seek a weight-saving. A weight-saving of this type obtained due to the invention may in particular be used for additional or denser explosive. The performance of the entire piercing military projectile 3 can therefore be improved using the connecting element 1 according to the invention.

As well as contributing to the mechanical strength of the body of the projectile, the longitudinal extension 15, 25 of the connecting element 1 provides a contact face 16, 26 with a large surface area, which is sufficient to enable bonding between the body 4 made of composite material and the connecting element 1 (made of metal, preferably of steel). By using bonding to connect these parts rigidly, there is no need to drill the composite material (for example for fastening with screws), which could be conducive to breakage upon impact with a target 20. The fibres making up the composite material (and providing the basic mechanical strength of the composite material) are therefore not damaged or cut. The mechanical properties of the composite material are therefore not damaged by the fastening. In addition, the adhesive used can be chosen according to the environmental conditions in which the projectile 3 is used, which allows the fastening to be improved.

Figure 1:
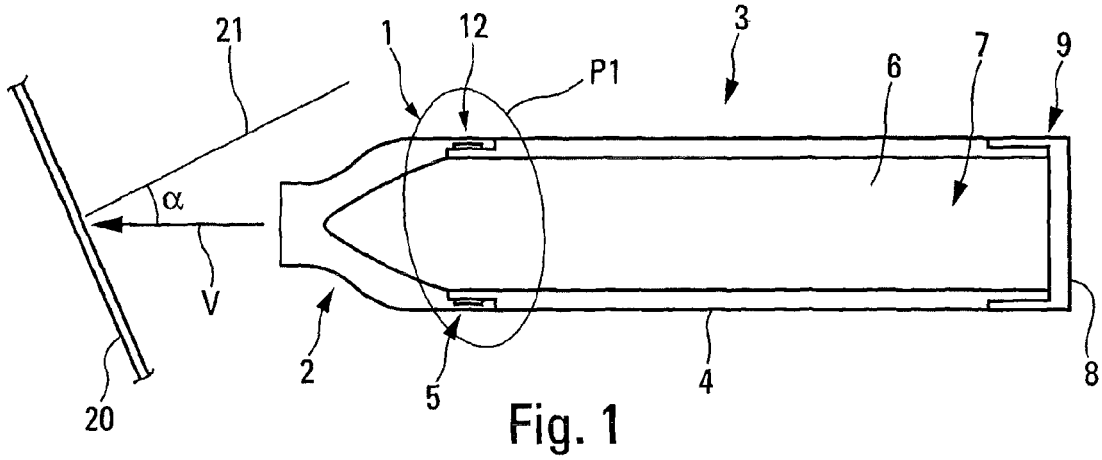
FIG. 1 is a diagrammatic view of a piercing military projectile provided with a connecting element according to a first embodiment of the invention.
Figure 2:
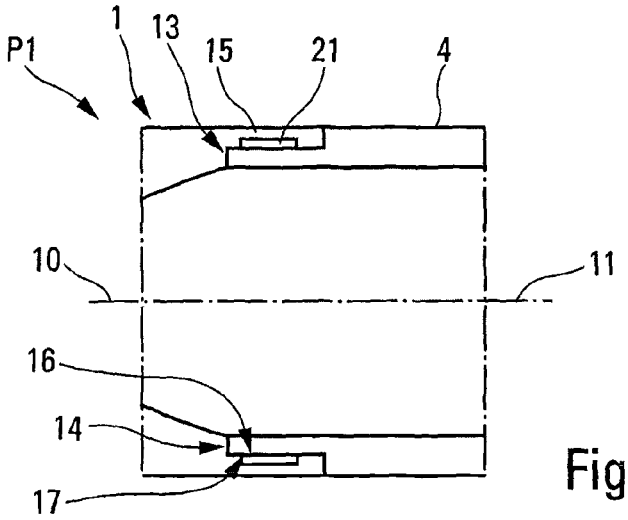
FIG. 2 is an enlarged view of a portion of FIG. 1, showing the connection.
Figure 3:
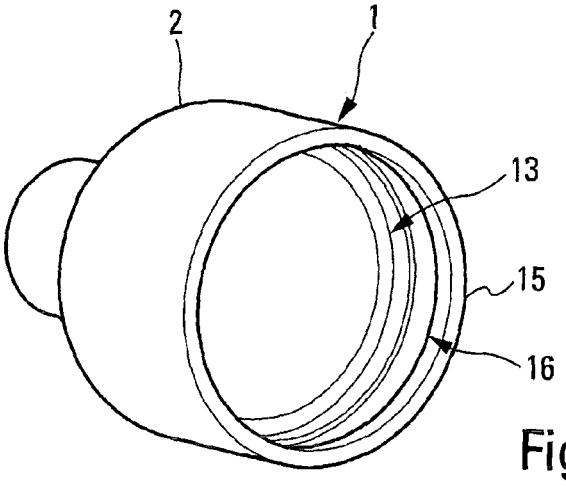
FIG. 3 is a perspective view of a connecting element according to the first embodiment of the invention.

In a first embodiment (shown in FIGS. 1 to 5), said longitudinal rearward extension 15 has a internal diameter suited to (i.e. very slightly greater than) the external diameter of the cylindrical body 4 so that it can receive the front portion thereof, while coming into contact laterally (via the contact face 16) with a radially external face 17 thereof, as shown in FIG. 2 which is an enlarged view of a portion P1 of FIG. 1. In this embodiment, the longitudinal extension 15 of the connecting element 1 therefore surrounds the front portion 5 of the cylindrical body 4 and is bonded by its radially internal face 16 to the radially external face 17 thereof. This face 16 may be longitudinal (FIGS. 1 to 3 and 5) or slightly conical (FIG. 4).

In a particular embodiment, said contact face 16 of said longitudinal extension 15, intended to come into contact with the cylindrical body 4, is provided with at least one channel 21 forming a, preferably annular, recess which is able to receive the adhesive. This channel 21, shown in particular in FIGS. 1 and 2, has dimensions that allow it to receive enough adhesive to produce appropriate fastening.

In this first embodiment, said abutment 13 has at least one contact surface 13A, 13B, and preferably a plurality of contact surfaces which succeed each other in the radial direction (directly or via the face 16). In the context of the invention, this type of contact surface may:

- either be situated in a plane that is radial relative to said longitudinal axis 10, as with the contact surfaces 13A shown in FIG. 4;
- or have a conical shape which, towards the rear, extends outwards, as with the contact surfaces 13B shown in FIG. 5.

In the context of the present invention, any possible combination of these different contact surfaces 13A, 13B and 16 can be envisaged. This allows advantageous contact to be produced between the abutment 13 and the front face 14 of the cylindrical body 4, in particular to transmit the forces producing the axial compression effectively to said cylindrical body 4. Therefore, preferably, when moving on the axis of the projectile 3 in the direction of increasing pressure on impact, in other words from rear to front, successive walls are introduced progressively by means of conical portions.

In addition, in a second embodiment (shown in FIGS. 6 to 8), the longitudinal rearward extension 25 of the connecting element 1 has an external diameter that is suited to (i.e. very slightly less than) the internal diameter of the cylindrical body 4 so that it can be inserted therein, while coming into contact laterally (via an external contact face 26) with a radially internal face 27 thereof, as shown in FIG. 7 which is an enlarged view of a portion P2 of FIG. 6. In this second embodiment, the longitudinal extension 25 of the connecting element 1 therefore penetrates into the front portion 5 of the cylindrical body 4 and is bonded by its radially external face 26 to the radially internal face 27 thereof.

Preferably, in this second embodiment, the longitudinal extension 25 also comprises an annular lip 22 connected to the outer edge of the abutment 23 and arranged so as to be able to come into contact laterally with a radially external face 28 of the front side 5 of the cylindrical body 4. The length of this annular lip 22 is of the same order of magnitude as the thickness of the composite body 4. Said annular lip 22 therefore allows the composite material to be retained upon impact and prevents delamination at the end 5 thereof, due to crushing against a more rigid structure (the steel of the nose).

As shown in FIG. 7 for example, the lip 22 is arranged longitudinally opposite said longitudinal extension 25 to form with said abutment 23 and said extension 25 a housing 29 for the front portion 5 of the body 4 made of composite material, allowing three-way contact between the connecting element 1 and said front portion 5.

Moreover, in particular to improve assembly, said lip 22 is bevelled and tapers rearwards, as shown in particular in FIG. 7.

Furthermore, in a first variant (applied to either of the above-mentioned first and second embodiments, and not illustrated), said connecting element 1 is an independent element which is used as an intermediate connecting element between a metal nose 2 and a cylindrical body 4 of a projectile 3. To do this, said connecting element 1 comprises, at the front portion thereof, conventional connection means allowing it to be connected, for example by screwing, to a metal nose of a piercing military projectile. This type of metal-to-metal connection is easy to produce and has good mechanical strength. The connecting element according to this first variant has, in particular, the advantage that it can be produced easily.

Moreover, in a second variant (also applied to either of the above-mentioned first or second embodiments), said connecting element 1 corresponds to the rear portion of a metal nose 2 of a piercing military projectile 3, as shown in the figures (although the nose 2 is only shown in part). In this embodiment, the connecting element 1 is therefore an integral part of the metal nose 2 which is designed to be mounted directly on the cylindrical body 4 of the projectile 3. This integration means that no connection means is needed between the nose 2 and the connecting element 1.

The connecting element 1 according to the invention, which therefore contributes to the retention of the composite material and plays a dominant role in the mechanical impact resistance of the entire projectile 3, also has the following advantages:

- it can be produced simply;
- it is suited to any type of composite material; and
- it allows optimised use of said composite material (by working principally in axial resistance) and simplifies the production of the cylindrical body 4. In fact, the portion of the projectile 3 made of composite material may for example be produced in the form of a cylinder or tube (or in any other simple geometric shape), instead of a more complex geometry.

In a particular embodiment, said composite material of the cylindrical body 4 comprises unbalanced fibre weaving, i.e. with a proportion of axial fibres that is different from (and greater than) the proportion of radial fibres. This provides in particular increased resistance of the cylindrical body 4 to axial compression, which represents the greatest stress that said cylindrical body must bear, as mentioned above.

In addition, in a particular embodiment, the radially successive metal or composite walls of said projectile 3 at the connection, are such that the rigidity thereof under pressure increases radially outwards from the axis 11, so that each of them is pressed firmly and laterally against the outer wall thereof.

In the above description, which relates to the preferred embodiment of the invention, the connecting element 1 is intended to connect a metal nose 2 to a composite-material body 4 on a projectile. However, in the context of the present invention, the connecting element can also be used to connect another element, in particular rear closing means such as the above-mentioned means 8, to the body made of composite material. Of course, the forces are less significant at the rear than at the front of the projectile 3.

The invention claimed is:

1. Penetrating projectile provided at least with a body (4) made of a composite material and a metal nose (2) arranged at the front of said body (4), and a connecting element (1) which is arranged so as to attach said metal nose of said penetrating military projectile (3) to said body (4), said connecting element (1) having a longitudinal axis (10), the portion (12) of said connecting element (1) intended to be attached to said body (4) comprising at least:

- an annular stop (13, 23) which is centered relative to the longitudinal axis (10) and is intended to come into contact with an edge (14, 24) of said body (4) made of a composite material for transmitting an axial compression;
- a longitudinal extension (15, 25) which is defined from said stop (13, 23), comprises a contact face (16, 26) and has a shape and a diameter which are adapted to said body (4), such that the contact face (16, 26) of said extension comes laterally into contact with a peripheral surface (17, 27) of said body, wherein said longitudinal extension (25) has a diameter which is adapted to said body (4) so as to be able to come laterally into contact with a radially inner face (27) of said body; and
- an annular lip (22) which is attached to the outer edge of the stop (23) and is longitudinally arranged opposite said longitudinal extension (25) so as to be able to come laterally into contact with a radially external face (28) of said body (4),
- wherein the contact face (16, 26) of said longitudinal extension (15, 25), which face contacts the body (4) when said body (4) and said connecting element (a) are assembled, is provided with at least one channel (21), and
- wherein, when said body (4) and said connecting element are assembled:
  - (A) said channel (21) defines a gap between the contact face (16, 26) and the longitudinal extension (15, 25), and
  - (B) the contact face (16) contacts the body (4) longitudinally forward of and behind said at least one channel (21).

2. Projectile according to claim 1, wherein longitudinal extension (15) has a diameter which is adapted to said body (4) so as to be able to come laterally into contact with a radially outer face (17) of said body.

3. Projectile according to claim 2, wherein said stop (13) comprises at least one contact surface (13A, 13B) in a general radial direction.

4. Projectile according to claim 3, wherein said stop (13) comprises a plurality of contact surfaces (13A, 13B) which succeed one another in the radial direction.

5. Projectile according to claim 3, wherein at least one contact surface (13A) is located in a plane which is radial with respect to said longitudinal axis (10).

6. Projectile according to claim 3, wherein at least one contact surface (13B) is of a conical shape which extends outwards towards the rear.

7. Projectile according to claim 1, wherein the radially successive walls of said projectile (3) in the region of the connection are such that the rigidity thereof under pressure increases radially outwards.

8. Projectile according to claim 1, wherein said connecting element (1) is arranged so as to attach the metal nose (2) to the body (4) made of a composite material.

9. Projectile according to claim 8, wherein said connecting element comprises, in the region of its front portion, connecting means which allow it to be attached to the metal nose.

10. Projectile according to claim 8, wherein the rear portion of the metal nose (2) comprises said connecting element (1).

11. Projectile according to claim 1, wherein the gap extends the longitudinal distance of the channel.

12. Projectile according to claim 1, wherein the connecting element comprises metal.

* * * * *